US006837689B2

(12) United States Patent
van Doan et al.

(10) Patent No.: US 6,837,689 B2
(45) Date of Patent: Jan. 4, 2005

(54) ROTARY VANE PUMP

(75) Inventors: Nguyen van Doan, Neu-Anspach (DE); Waldemar Hebisch, Gross Gerau (DE)

(73) Assignee: Luk Fahrzeug-Hydraulik GmbH & Co. KG, Bad Homburg (DE)

( * ) Notice: Subject to any disclaimer, the term of this patent is extended or adjusted under 35 U.S.C. 154(b) by 0 days.

(21) Appl. No.: 10/352,313

(22) Filed: Jan. 27, 2003

(65) Prior Publication Data

US 2003/0138330 A1 Jul. 24, 2003

Related U.S. Application Data

(63) Continuation of application No. PCT/DE01/02497, filed on Jul. 5, 2001.

(30) Foreign Application Priority Data

Jul. 27, 2000 (DE) ..... 200 22 423 U

(51) Int. Cl.[7] ..... F04B 23/08
(52) U.S. Cl. ..... 417/87; 417/151
(58) Field of Search ..... 417/87, 159, 198, 417/179, 151; 418/15

(56) References Cited

U.S. PATENT DOCUMENTS 3,359,913 A 12/1967 Halsey
3,366,065 A 1/1968 Pace, Jr. et al.
4,408,964 A * 10/1983 Mochizuki et al. ..... 417/310
4,971,525 A 11/1990 Nakayoshi et al.
5,496,152 A * 3/1996 Heise et al. ..... 417/87
6,227,816 B1 * 5/2001 Breuer et al. ..... 417/310
6,270,385 B1 * 8/2001 Varney et al. ..... 440/38
6,413,064 B1 * 7/2002 Parsch et al. ..... 418/149

FOREIGN PATENT DOCUMENTS

DE 41 22 433 A1 1/1993
DE 41 38 516 A1 5/1993
DE 196 37 224 A1 3/1998
DE 198 36 628 A1 2/2000

* cited by examiner

*Primary Examiner*—Charles G. Freay
(74) *Attorney, Agent, or Firm*—Alston & Bird LLP

(57) ABSTRACT

A rotary vane pump for delivering a fluid and which has a housing which accommodates a rotatable delivery device (1) and which includes a feed channel (13) for receiving the fluid from a tank or the like. The feed channel communicates with a jet chamber (15) which in turn communicates via one or more suction channels (20) to at least two suction chambers which communicate with the intake region of the pump. An injector device (14) injects a pressurized fluid into the jet chamber to entrain and advance the fluid entering from the feed channel (13), and means are provided for influencing the flow of the fluid so as to achieve essentially the same volume flow into the two suction chambers.

28 Claims, 5 Drawing Sheets

B-B

ROTARY VANE PUMP

CROSS REFERENCE TO RELATED APPLICATION

This is a continuation of PCT/DE01/02497, filed Jul. 5, 2001, and designating the U.S.

BACKGROUND OF THE INVENTION

The present invention relates to a rotary vane pump for delivering a fluid, and which includes a delivery device accommodated in a housing, a feed channel for the fluid which is formed in the housing, and which extends in the suction region of the delivery device, and terminates in a jet chamber upstream thereof, and with an injector device, which is used to deliver the fluid, which discharges with a jet nozzle into a jet chamber. In so doing, the jet nozzle injects the fluid under a high pressure into the fluid entering the jet chamber from the feed channel, thereby entraining or accelerating it, with the jet chamber being hydraulically connected via a suction channel to at least two suction chambers of the delivery device.

Pumps of the kind under discussion, for example vane cell pumps are known from practice, for example, from U.S. Pat. Nos. 5,496,152 and 4,971,525, and DE 41 22 433 C2.

Pumps of the described type are used, for example, in steering boosters, and they deliver a special oil to provide assistance to the steering force that is to be applied to the steering wheel of an automobile. Preferably, the pumps are vane cell pumps, which take in oil from a reservoir outside of the pump, for example, an external tank. Such pumps are normally equipped with a flow control valve, which permits delivering the oil from the high-pressure region to the intake region of the pump. Effective a certain pump speed, and with a constantly adjustable flow rate, the flow control valve opens a discharge bore, through which the oil under a high pressure is able to leave. The oil enters the intake area of the delivery device.

U.S. Pat. No. 5,496,152 discloses a pump of the described type, which comprises for realizing as much as possible an operation free from cavitations, a very special delivery system for delivering the tank oil. Specifically, an injector device is provided that operates in a manner similar to that of a water jet pump. The injector device is biased by a fluid flowing at a high velocity, which is supplied to the injector device from the high-pressure area, preferably via a flow control valve. The injector device injects this high velocity fluid into the fluid leaving the feed channel in the area of a jet chamber upstream of the delivery device. As a result, the fluid coming from the tank is entrained or accelerated. From there, it enters the intake area of the delivery device via a further channel system.

The technology disclosed in the '152 patent and relating to the use of an injector device, however, is problematic, inasmuch as the disclosed injector device operates with a jet nozzle only on one side of the housing, and must deliver from there the fluid coming from the tank to both sides of the housing, i.e., into the respective intake regions, to make the fluid available to an adequate extent on both sides of the housing to the suction chambers associated on both sides of the delivery device or rotational group.

The main problem underlying the prior art may be seen in that the valve jet that flows off on the valve piston at a high velocity into the jet nozzle, preferably upstream of the valve piston under a high pressure, if need be, extends basically obliquely, and that symmetrically configured channels are therefore unsuitable.

Because of the normally different supply of jets to the suction chambers arranged on both sides, different pressure conditions occur in the fluid, which in turn leads to a different loading of the suction chambers on both sides. In particular, in the case of high flow rates of the pump, this will lead to cavitation or to damage resulting from cavitation. Furthermore, an even filling of the intake areas on both sides becomes questionable.

At any rate, the prior art does not ensure that the suction chambers are uniformly filled. Quite the contrary, pressure conditions and flow velocities of the fluid, which prevail upstream of the suction chambers, lead to a different filling, which in turn causes the foregoing problems, i.e., cavitation and also noise in the pump.

It is therefore an object of the present invention to improve and further develop a pump of the described type in such a manner that cavitation and noise in the pump are essentially avoided with simple constructional means.

SUMMARY OF THE INVENTION

The above and other objects and advantages of the invention are achieved by the provision of a pump of the initially described type, wherein in the inflow region of the jet chamber and/or in the suction channel, means are provided for influencing the flow of the fluid, and so that an at least essentially identical volume flow is achieved into the two suction chambers.

In accordance with the invention, it has been recognized in a first step that cavitations or noise as occur in pumps of the art, are due to a different filling of the suction chambers of the delivery device. This finding required an in-depth technical analysis, in particular with respect to the jet direction. When viewed alone, such an analysis is inventive.

In a next step, it has been discovered that one can eliminate the problems of the art in that one guarantees an at least largely identical volume flow into the two suction chambers. Finally, it has been recognized that one does not need to modify, for example, the jet nozzle or the pressure of the fluid that is to be injected through the jet nozzle, but that one provides means for influencing the fluid entering the jet chamber in the inflow area of the jet chamber and/or in the suction channel, so that, when distributed over the suction chambers, an at least largely identical volume flow into the suction chambers is bound to result.

Finally, the flow path to the suction chambers is configured in accordance with one embodiment of the invention in such a manner that the entire volume flow is divided into two identical partial flows right to the suction chambers. Responsible for such an identical or at least largely identical division of the volume flow are means in the flow path, which influence the flow of the fluid. These means may be integral components of the flow path and, thus, of the housing. In this respect, it should be noted that the pressure of the fluid that is injected through the jet nozzle, results from external forces at the edges or in the edge regions, and constantly changes as a result of the path of the flow.

Within the scope of a simple embodiment, the pump according to the invention may be of such a construction that it discharges are unilaterally into a single jet chamber. In this case, this single jet chamber hydraulically connects via a suction channel to two or more suction chambers of the delivery device. However, it is likewise possible that the feed channel ends on both sides of the delivery device with respectively one subchannel in a jet chamber upstream of the delivery device, and that the injector device discharges on both sides with respectively one jet nozzle into each of the two jet chambers. Both jet chambers hydraulically connect, each via a suction channel or via corresponding subchannels, to at least two suction chambers of the delivery device. This results in that on both sides, means are provided for equally influencing the flow of the fluid. These means ensure an at least largely identical volume flow into the suction chambers on both sides.

As a further aspect of the present invention, it has been found that the jet of the fluid directed into each jet chamber may be obliquely directed in the direction of flow to the wall of the jet chamber opposite to the jet nozzle, and that it impacts there in a correspondingly oblique manner. The angle of the jet is additionally influenced such that its kinetic energy can be optimally used for a uniform filling of the suction chambers. In this connection, it is intended to avoid in particular turbulences and jet erosions.

For further assisting an optimal flow of the fluid directly after leaving the injector or jet nozzle, it will be of further advantage, when in the impact region of the wall, a guide device similar to a ski-jump is formed, which is approximately adapted or adjusted to the jet angle of the fluid. For purposes of avoiding damaging turbulences, the ski-jump type guide surface is used to receive the jet in a proper manner and to forward it in a purposeful way with the least possible losses of kinetic energy.

In a further advantageous manner, the impact region or the ski-jump type guide surface in the jet chamber is followed by a cross sectional taper of the flow path that is used for consolidating the flow. As a result of this cross sectional taper and, with it, the consolidation of the flow, an acceleration of the flow is achieved because of a resultant nozzle effect. This cross sectional taper in turn could be followed by a deflection, and finally by a division into the two suction channels. In this instance, the change in direction imposed by the deflection influences the subsequent division of the flow into the two suction channels. In the region of the division, one could again provide guide devices, which may be associated, for example, with the respective walls of the flow path or suction channels. The deflection and division of the entire flow is to occur at any rate such that in the two suction channels, approximately the same volume flow results, which in turn reaches the inlet of suction chambers via the two suction channels.

The jet chamber could be hydraulically connected via two separate suction channels to respectively at least one suction chamber. In other words, the jet chamber is divided into two separate suction channels, which in turn hydraulically connect the jet chamber to the suction chambers. Regardless of the length of the suction channels and regardless of the course of the respective suction channel, the means for influencing the flow are configured such that a largely identical volume flow results via the respective suction channels to the two suction chambers. Responsible for this are the means that influence the flow of the fluid. These means also include, for example, the ski-jump type guide surface provided in the jet chamber, and in particular the purposeful adaptation of the configuration of walls, "noses", or the like. Corresponding devices are also possible in the suction channels.

As previously addressed, it is possible to influence the flow from the jet chamber into the two suction channels by the configuration of the flow path. In this respect, the flow into the two suction channels is at least slightly deflected. This deflection serves to influence the volume flow that is directed into the suction channels, so that to this extent the flow into the two suction channels is already divided with respect to making the volume flow uniform.

In accordance with the other basic conditions concerning the configuration of the suction channels, same could be made asymmetric and differently long.

In the suction channels and/or directly upstream of the suction chambers, it is possible to provide further means for influencing the flow, in particular cross sectional modifications and/or guide devices to have there a final influence on the volume flow entering the suction chambers. At this point, the previously divided volume flow may undergo a fine tuning. Cross sectional reductions, further deflections, or even a labyrinth-like configuration of the suction channel are adequate means for influencing the flow, more specifically the flow velocity, the prevalent pressure, and thus the volume flow.

Within the scope of an alternative configuration of the flow path from the jet chamber to the suction chambers, the jet chamber could be hydraulically connected to a single suction channel which leads to at least two successively arranged suction chambers. Likewise to this extent, it would be possible to arrange in a first step downstream of the impact area in the jet chamber which is impacted by the fluid injected thereinto, or the ski-jump type guide surface, a cross sectional taper of the flow path that is used to consolidate the flow. In this connection, the cross section of the flow may decrease toward the suction chamber in a constant, curved, or even stepped manner. The consolidation of the flow leads to an acceleration of the fluid up to the first suction chamber.

Furthermore, it is possible to provide in the suction channel, in particular directly upstream of the suction chambers, further means for influencing the flow, in particular guide devices. Directly upstream of the suction chambers, it would be possible to provide, in the same way as in the impact region in the jet chamber, ski-jump type guide surfaces, which direct the flow into the suction chambers, while avoiding turbulences. Both in any points in the suction channel and directly upstream of the suction chambers, the guide devices are formed, preferably made integral with the housing.

In a further advantageous manner, the cross section of the flow between the first and the second suction chamber is at least the same as the cross section of the flow upstream of the first suction chamber. In this connection, it is to be made certain that the volume flows into the two suction chambers are divided at least largely uniformly, so that the suction chambers are evenly loaded. Downstream of the second suction chamber, it would be possible to provide a rebounding wall causing a deflection, so that a deflection occurs and, with it, a repeated influence on the volume flow into the second suction chamber. At any rate, the suction channel could end directly downstream of the second suction chamber with the there provided deflection wall.

Within the scope of a further embodiment, the suction channel could be hydraulically connected in the region between the two suction chambers, or downstream of the rearmost suction chamber, when viewed in the direction of the flow, directly or via a bypass, to the jet chamber or to the region of the suction channel upstream of the first suction chamber. Such a hydraulic connection permits influencing the pressure conditions and, with that, also the volume flows upstream of the respective suction chambers, so that it is also possible to adjust the volume flows in this respect.

Besides the course of the suction channel and the arrangement for different guide devices, it is possible to influence the flow of the fluid, in particular the volume flow directed into the suction chambers by more extensive measures, namely by modifying the inside wall of the jet chamber and/or the suction channel or channels. In this respect, the surfaces could include structures and/or a coating, which influence the flow. Specifically, it would be possible to treat the surfaces of the inside walls, as needed. In this connection, a roughening of the surface leads to an increase of the flow resistance, and a smoothing or smooth coating of the surface to a reduction of the flow resistance and, thus, to an acceleration of the flow.

Finally, it should be noted that the housing may be closed on one side by a housing cover at the front end, and on the other side, if need be, by a bearing flange. In this respect, it is possible that the jet chamber formed on both sides of the delivery device is machined at least largely out of the housing cover and the bearing flange, if need be. Moreover, it is possible that the flow paths formed on both sides of the actual housing are made identical or different, depending on the geometries and requirements that are predetermined by the housing or the housing cover and/or the bearing flange.

There exist various possibilities of improving and further developing the teaching of the present invention in an advantageous manner. To this end, one may refer to the following description in greater detail of two embodiments of the invention with reference to the drawing. In conjunction with the description of the preferred embodiments of the invention with reference to the drawing, also generally preferred improvements and further developments of the teaching are described in greater detail.

DETAILED DESCRIPTION OF THE PREFERRED EMBODIMENTS

Figure 1:
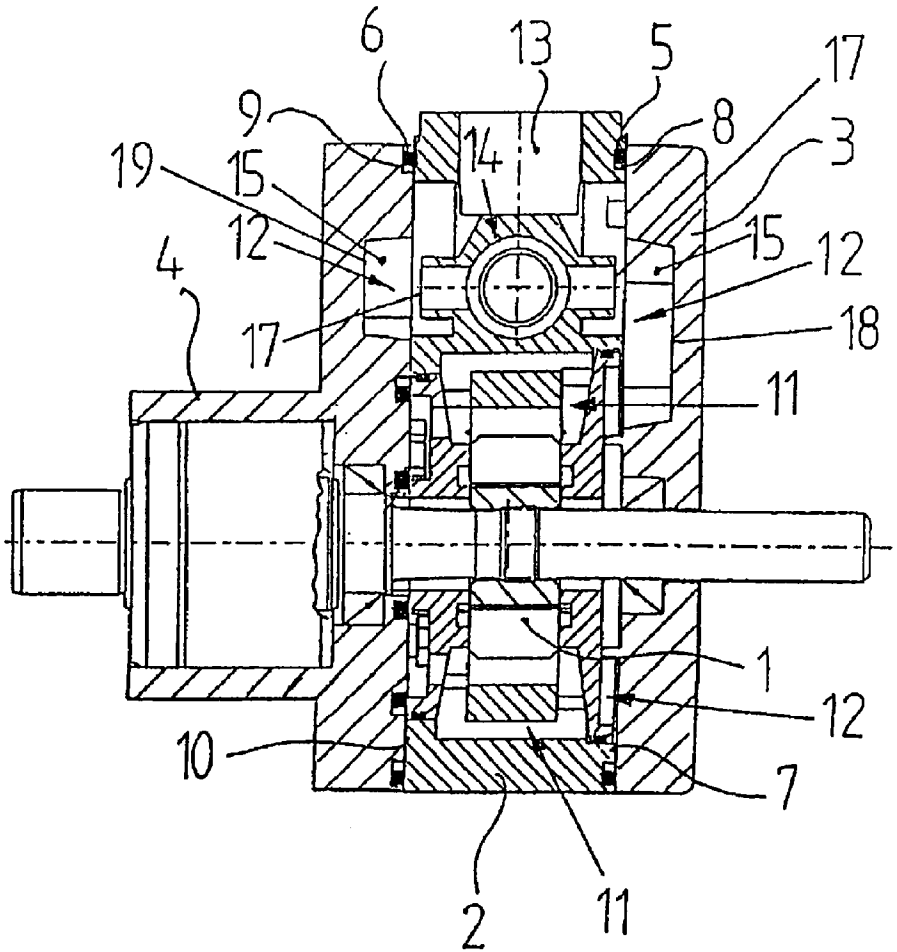
FIG. 1 is a schematic sectional side view of an embodiment of a pump of the described type.

FIG. 1, is a simplified sectional side view of a pump of the described type. Specifically, the pump is a vane cell pump with a rotatable delivery device 1 not described in greater detail. As regards the detailed configuration of such a rotatable delivery device 1 one may refer, for example, to DE 41 38 516 A1 and U.S. Pat. No. 5,496,152, the disclosures of which are incorporated by reference.

The illustrated pump comprises as essential components, a housing 2 and a delivery device accommodated therein, which is the foregoing rotatable delivery device 1. At the front end, a housing cover 3 is provided on the one side, which closes the housing 2, and a bearing flange 4 is connecting to the housing 2 on the other side. The actual housing 2 including the housing cover 3 and bearing flange 4 also could be very broadly referred to as the housing.

Between the housing 2 and the housing cover 3 on the one hand and between the housing 2 and the bearing flange 4 on the other hand, an outwardly operative seal 5, 6 is arranged, with the seal 5 that is operative relative to the housing cover 3 being inserted into a groove 8 arranged in a front face 7 of the housing 2. On the other side of the housing 2, the seal 6 is associated with the bearing flange 4 or inserted into a groove 9 machined out of the bearing flange 4. The groove 9 could also be provided in a front face 10 of the housing 2.

When viewed alone, it is already known from the art to provide between a pressure region 11 and a suction region 12 of the pump, a leakage path for the fluid, i.e., a leakage path for leakage oil that develops on the pressure side and is to be delivered to the suction side 12.

Figure 2:
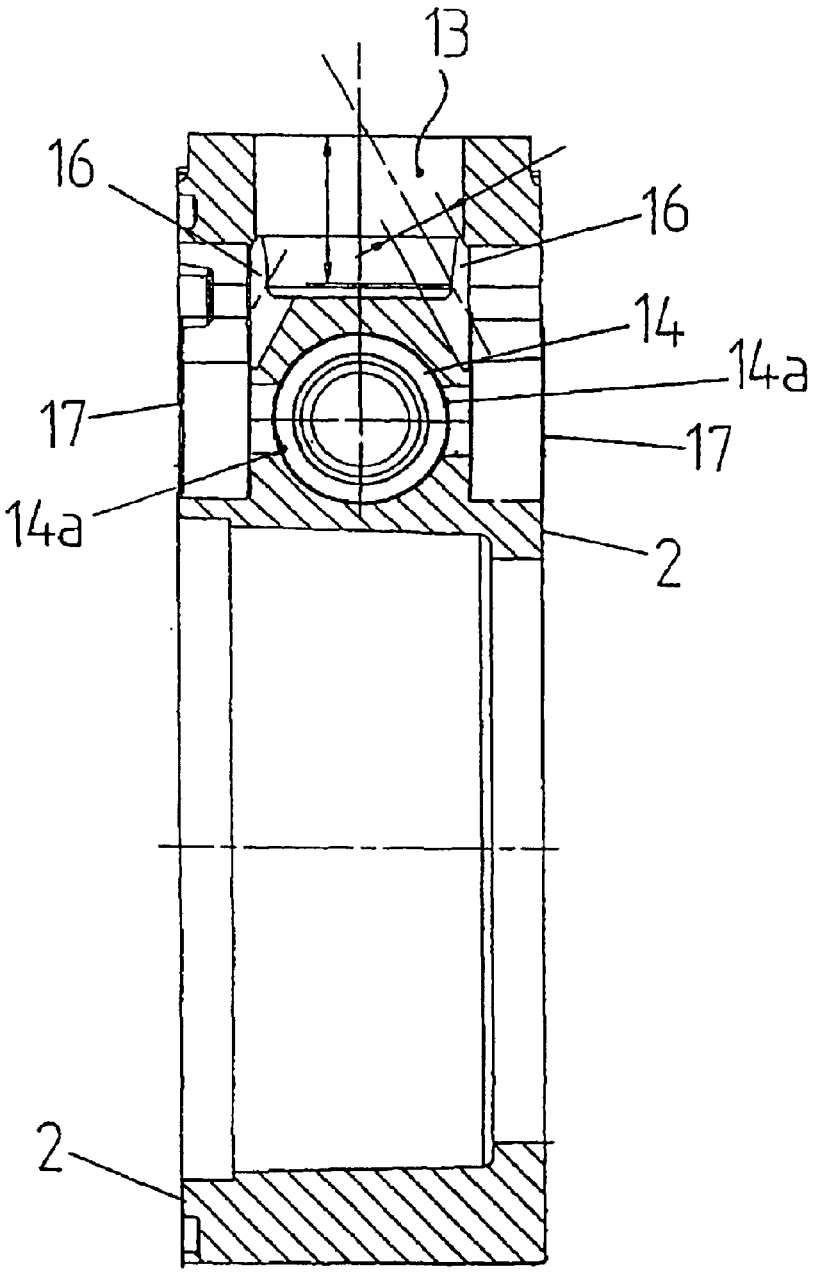
FIG. 2 is a schematic, sectional and enlarged side view of the subject matter of FIG. 1 without housing cover, without bearing flange, and without delivery device.

As best seen in FIGS. 1 and 2, a feed channel 13 for the fluid extends into the suction region 12. Furthermore, an injector device 14 operating similarly to a water jet pump is provided for delivering the fluid. This injector device 14 injects fluid that accumulates under a high pressure upstream of a flow control piston on the control edge of the valve piston, at a high velocity into a jet chamber 15 upstream of the delivery device 1 and, there, into a fluid that leaves the feed channel 13. It thereby accelerates or entrains the fluid.

On both sides of the delivery device 1, the feed channel 13 terminates with one subchannel 16 each in a separate jet chamber 15. The injector device discharges on two sides, so that a jet nozzle 17 of the injector device 14 is directed into each of the two jet chambers 15. If need be, the jet nozzles 17 may be shortened or omitted for purposes of not impeding the jet.

As shown in FIG. 1 and in FIG. 2, the injector device 14 is arranged in the center above the delivery device 1. In this arrangement, the jet nozzles 17 are aligned such that the fluid injected at a high velocity via the jet nozzle 17, impacts upon the fluid being accelerated approximately in the direction of flow thereof, so that it assists in accelerating the fluid coming from the tank. The fluid from the system reaches the two jet nozzles 17 via the feed channel 13, and the fluid from the pump reaches them via an injector device 14 and discharge bores 14*a*.

As can further be noted from FIG. 1, the jet chambers 15 formed on both sides of the delivery device 1 are largely machined out of the housing cover 3 on the one side, and out of the bearing flange 4 on the other side. On the one side, the jet nozzles 17 are orthogonally directed to a wall 18 of the housing cover 3 opposite to the outlet of the feed channel 13, and on the other side to a wall 19 of the bearing flange 4 opposite to the outlet of the feed channel 13. However, they may also be obliquely directed, on the one side to the wall 18 of the housing cover 3 opposite to the outlet of feed channel 13, and on the other side to the wall 19 of bearing flange 4 opposite to the outlet of feed channel 13 for purposes of effectively avoiding turbulences.

Figure 3:
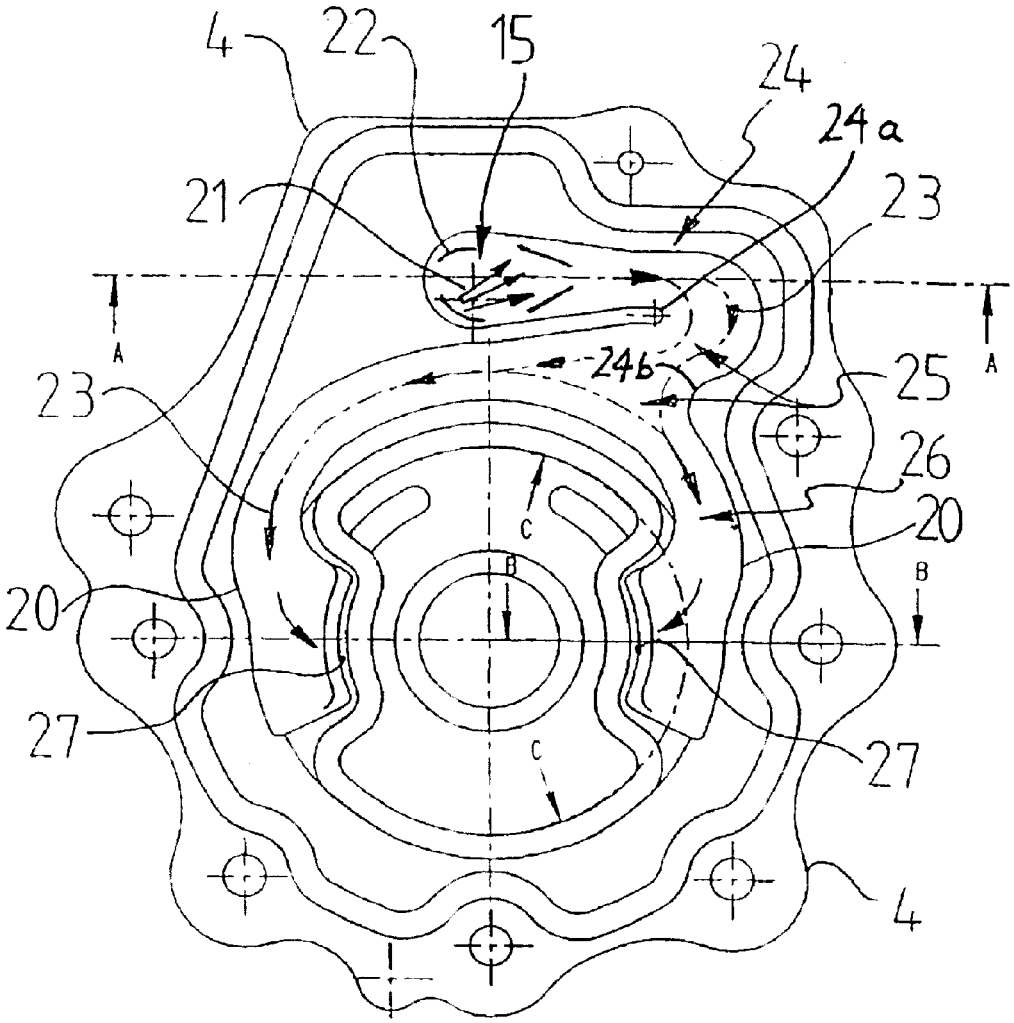
FIG. 3 is a schematic inside view of a bearing flange with two suction channels.

According to the illustration of FIG. 3, both the inflow region of the jet chamber 15 and a suction channel 20 accommodate means for influencing the flow of the fluid. These means ensure an at least largely identical volume flow into the two suction chambers (not shown in the Figures). The same applies to the second embodiment shown in FIG. 7.

As can further be noted from FIGS. 2 and 3, the feed channel 13 terminates on both sides of the delivery device 1 with respectively one subchannel 16 into a jet chamber 15 upstream of the delivery device 1, and the injector device 14 discharges on both sides with respectively one jet nozzle 17 into each of the two jet chambers 15.

After emerging on the valve piston at discharge bores 14*a*, the jet directed into the jet chamber 15, extends in the direction of flow obliquely to the wall of jet chamber 15 opposite to the jet nozzle 17. The oblique orientation of the jet is symbolically indicated in FIGS. 3–7 by the arrows which represent the jet at 21. At any rate, it is significant that the jet 21 directed into the jet chamber 15 obliquely impacts upon the wall 18 or 19 of jet chamber 15.

Figure 4:
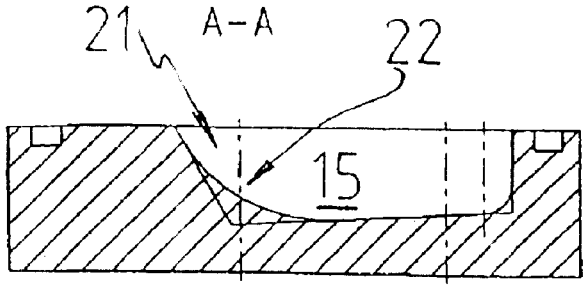
FIG. 4 is a sectional view of the subject matter of FIG. 3 along line A—A.
Figure 7:
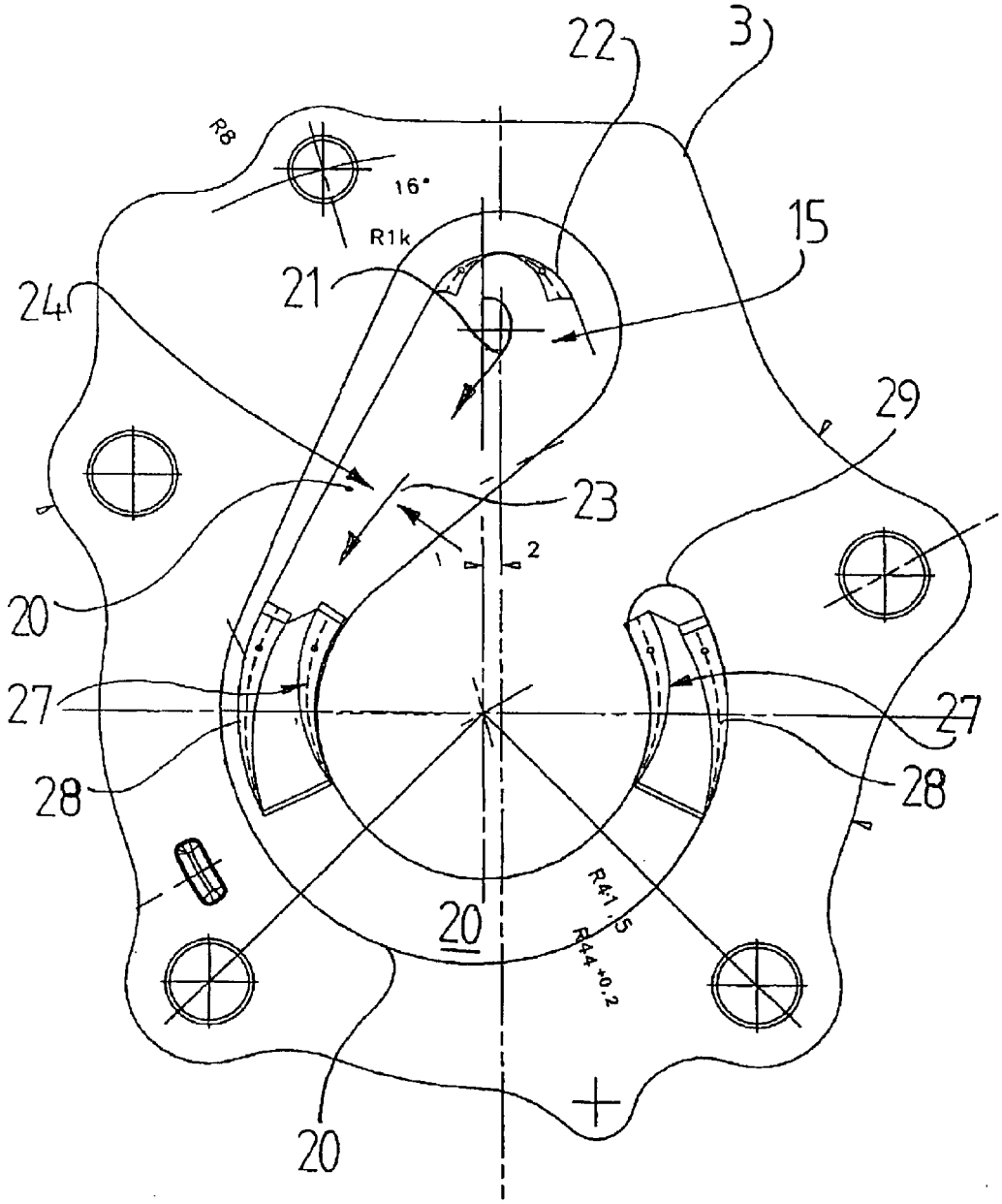
FIG. 7 is a schematic inside view of a housing cover, whose wall accommodates a singular suction channel.

According to the illustrated embodiments, as indicated in FIGS. 3, 4, and 7, a ski-jump type guide surface 22 is formed in the impact area of the jet 21. In this respect, the jet 21 impacts upon the guide surface 22, and continues from there in the direction of the suction channel 20 without developing turbulences.

In the embodiment shown in FIG. 3, the jet chamber 15 is hydraulically connected via two suction channels 20 to respectively one suction chamber of the delivery device 1 (not shown in the Figures). FIG. 3 further shows that the flow from the jet chamber 15 is deflected into the two suction channels 20 by the configuration of the flow path. This deflection of the flow is used to influence the volume flow that is directed into the suction channels 20.

The two suction channels 20 are made substantially symmetrical on both sides of the jet chamber 15. The impact region in the jet chamber 15 is followed by a cross sectional taper 24 of the flow path, which is used to consolidate the flow. Downstream of the cross sectional taper 24 is a deflection 23 and a division 25 into the two suction channels 20. In this arrangement, the formation of opposite projections 24*a*, 24*b* is of special importance.

As can further be noted from FIG. 3, further means for influencing the flow, namely cross sectional modifications and guide devices 22 are provided in the suction channels 20 and directly upstream of the suction chambers.

Figure 5:
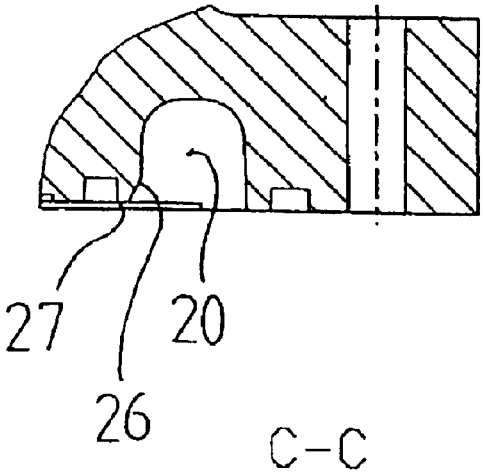
FIG. 5 is a partial, sectioned view of the subject matter of FIG. 3 along line B—B.
Figure 6:
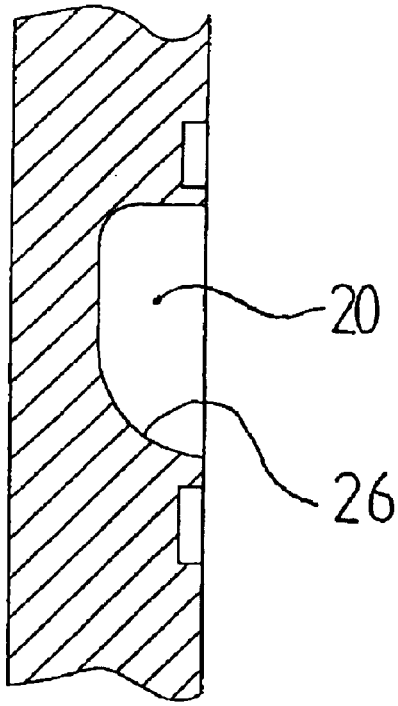
FIG. 6 is a partial, sectioned view of the subject matter of FIG. 3 along arcuate line C—C.

FIGS. 4, 5, and 6 are cross sectional views of the subject matter of FIG. 3. For example, best seen in FIG. 4 is the ski-jump type guide surface 22 formed in the jet chamber 15, which is used to deflect or direct the jet 21 without developing unnecessary turbulences.

FIG. 5 is a cross sectional view of the suction channel 20 in the region of the suction chamber, likewise with a corresponding guide device 26, which is an integral part of the wall. In this respect, the illustration of FIG. 6 is similar, which is an approximately axially sectioned view of the suction channel 20. Likewise in this illustration, one can note a guide device 26 in the wall of suction channel 20, namely at the end thereof. Likewise this guide device 26 assists the inflow into the suction chamber.

A further embodiment of the configuration of a suction channel according to the invention as shown in FIG. 7, relates to a housing cover 3, which accommodates at least one portion of the jet chamber 15 as well as a singular suction channel 20. Likewise in this embodiment, the jet 21 impacts upon a ski-jump type guide device 22, which influences the jet 21 in its direction of flow.

At any rate, as best seen in FIG. 7, the jet chamber is hydraulically connected via a single suction channel 20 to two successively arranged suction chambers (not shown in the Figures). The Figure shows only inlets 27 that are directed toward the suction chambers.

The impact region or ski-jump type guide device 22 in the jet chamber 15 is followed-by a cross sectional taper 24 of the flow path or suction channel 20, which serves to consolidate the flow. As further shown in FIG. 7, the cross section of the flow toward the first suction chamber or to its inlet 27 constantly decreases, thereby causing the flow to accelerate. In the suction channel 20, i.e., in the selected embodiment directly upstream of the inlet 27 to the suction chambers, additional means are provided for influencing the flow. These means are additional guide devices 28. Directly upstream of the suction chambers, ski-jump type guide devices 28 are provided for assisting likewise the flow into the inlet 27. The guide devices 28 are integral parts of the housing cover 3.

As further indicated in FIG. 7, the cross section of the flow between the first and the second suction chamber is made smaller (for example, by a flatter constructed groove) than the cross section of the flow upstream of the first suction chamber or its inlet 27. Furthermore, the cross section of the flow decreases at least slightly between the first suction chamber and the second suction chamber or between the two inlets 27.

At the end of the suction channel 20, more specifically downstream of the second suction chamber or downstream of its inlet 27, a rebounding wall 29 is formed, which causes a deflection and again assists the flow into the second chamber of its inlet 27.

The above described embodiments are not intended to limit the invention. Rather within the scope of the present disclosure, numerous changes and modifications are possible, in particular such variants, elements and combinations and/or features, which a person of skill in the art is able to take with respect to accomplishing the object, for example, by combining or modifying features, or elements, or procedural steps that are described in connection therewith both in the general specification and embodiments and in the claims, and contained in the drawings, and which lead by combined features to a new subject matter or to new process steps or sequences of process steps, also to the extent that they relate to production, testing, and working methods.

What is claimed is:

1. A pump for delivering a fluid comprising a housing which comprises an interior chamber which accommodates a rotatable delivery device for displacing a fluid from an intake region to a delivery region, a feed channel formed in the housing and which communicates with a jet chamber which in turn communicates via at least one suction channel to at least two suction chambers which communicate with the intake region of the pump, and an injector device for injecting a pressurized fluid via a jet nozzle into the at least one jet chamber so as to entrain the fluid which flows into the jet chamber from the feed channel, said jet chamber including an impact area which is impacted by the injected fluid, with the impact area comprising a transverse wall which is oriented so as to initially deflect all of the injected fluid and the entrained fluid in one direction along the at least one suction channel and then to the at least two suction chambers, and wherein the impact area and/or the one suction channel includes means for influencing the flow of the fluid so as to achieve essentially the same volume flow into the two suction chambers.

2. The pump of claim 1 wherein the jet nozzle and the transverse wall are oriented with respect to each other such that the injected fluid impacts upon the wall in an oblique direction so as to advance the fluid in the one direction along the one suction channel toward the two suction chambers.

3. The pump of claim 2 wherein said transverse wall includes a ski-jump like guide surface at the impact area which is impacted by the injected fluid, with the guide surface being oriented so as to advance the fluid in the one direction along the one suction channel toward the two suction chambers.

4. The pump of claim 2 wherein the jet chamber is connected via two suction channels to the two suction chambers respectively.

5. The pump of claim 4 wherein the impact area which is impacted by the injected fluid is followed by a region of narrowing cross section so as to consolidate the fluid.

6. The pump of claim 5 wherein the region of narrowing cross section is followed by a curved region which opens into the two suction channels.

7. The pump of claim 4 wherein the means for influencing the flow of the fluid comprises a cross sectional modification and/or a guide surface for influencing the flow in each of the two suction channels at a location directly upstream of the suction chambers.

8. The pump of claim 2 wherein the jet chamber communicates with one suction channel which serially communicates with the two suction chambers.

9. The pump of claim 8 wherein the impact area which is impacted by the injected fluid is followed by a region of narrowing cross section so as to consolidate the fluid.

10. The pump of claim 8 wherein the cross section of the one suction channel decreases toward a first of the two serially arranged suction chambers.

11. The pump of claim 10 wherein the one suction channel includes a guide surface of predetermined cross sectional configuration for influencing the fluid flow toward the suction chambers.

12. The pump of claim 11 wherein the guide surface takes the form of a ski-jump like guide surface.

13. The pump of claim 8 wherein the cross section of the one suction channel between the first and the second serially arranged suction chambers is smaller than the cross section upstream of the first suction chamber.

14. The pump of claim 10 wherein the cross section of the one suction channel decreases between the first and the second serially arranged suction chambers.

15. The pump of claim 8 wherein the region of the one suction channel between the two suction chambers or downstream of the second serially arranged suction chamber, is connected to the jet chamber or to the region of the suction channel upstream of the first suction chamber.

16. The pump of claim 1 wherein the means for influencing the flow of the fluid includes a surface coating on the inside wall of the jet chamber and/or the at least one suction channel.

17. A pump for delivering a fluid comprising a housing which comprises an interior chamber and opposite sides, a rotary vane delivery device accommodated in the interior chamber of the housing for displacing a fluid from an intake region to a delivery region of the pump, a jet chamber positioned on each side of the housing and communicating with the intake region on the same side thereof, a feed channel for delivering a fluid to the pump and including two subchannels communicating with respective ones of the jet chambers, an injector device for injecting a pressurized fluid into each of the two jet chambers so as to entrain the fluid which flows into the two jet chambers from the associated subchannel of the feed channel and convey the fluid toward the intake region, wherein each of the jet chambers is defined at least in part by a transverse wall, and wherein the wall of each jet chamber is configured such that the fluid from the injector device impacts thereupon in an oblique direction so as to initially advance all of the injected fluid and the entrained fluid in one direction toward the intake region.

18. The pump of claim 17 wherein the injector device is positioned centrally between the two jet chambers and includes two nozzles which are oriented in generally opposite directions, so that the nozzles are directed toward respective ones of the two jet chambers.

19. The pump of claim 18 wherein the two nozzles are coaxially aligned.

20. The pump of claim 17 further comprising a cover overlying one side of the housing and a bearing flange overlying the other side of the housing, and wherein one of the jet chambers is integrally formed at least in part by the cover and the other jet chamber is integrally formed at least in part by the bearing flange.

21. The pump of claim 17 wherein each jet chamber communicates with the intake region via at least one suction channel which communicates with at least two suction chambers on the same side of the housing.

22. The pump of claim 21 wherein the transverse wall of each jet chamber includes an impact area which is impacted by the fluid injected by the injector device, and wherein the impact area and/or the one suction channel includes means for influencing the flow of the fluid so as to achieve essentially the same volume flow into the two suction chambers.

23. A pump for delivering a fluid comprising a housing which comprises an interior chamber which accommodates a rotatable delivery device for displacing a fluid from an intake region to a delivery region, a feed channel formed in the housing and which communicates with a jet chamber which in turn communicates via at least one suction channel to at least two suction chambers which communicate with the intake region of the pump, and an injector device for injecting a pressurized fluid via a jet nozzle into the at least one jet chamber so as to entrain the fluid which flows into the jet chamber from the feed channel and thereby advance the fluid along the one suction channel and to the at least two suction chambers, said one jet chamber including an impact area which is impacted by the fluid injected by the injector device, and wherein the impact area and/or the one suction channel includes means for influencing the flow of the fluid so as to achieve essentially the same volume flow into the two suction chambers, wherein the impact area is defined by a transverse wall, and wherein the jet nozzle and the transverse wall are oriented with respect to each other such that the injected fluid impacts upon the wall in an oblique direction so as to advance the fluid along the one suction channel toward the two suction chambers, wherein the jet chamber is connected via two suction channels to the two suction chambers respectively, wherein the impact area which is impacted by the injected fluid is followed by a region of narrowing cross section so as to consolidate the fluid, and wherein the region of narrowing cross section is followed by a curved region which opens into the two suction channels.

24. A pump for delivering a fluid comprising a housing which comprises an interior chamber which accommodates a rotatable delivery device for displacing a fluid from an intake region to a delivery region, a feed channel formed in the housing and which communicates with a jet chamber which in turn communicates via at least one suction channel to at least two suction chambers which communicate with the intake region of the pump, and an injector device for injecting a pressurized fluid via a jet nozzle into the at least one jet chamber so as to entrain the fluid which flows into the jet chamber from the feed channel and thereby advance the fluid along the one suction channel and to the at least two suction chambers, said one jet chamber including an impact area which is impacted by the fluid injected by the injector device, and wherein the impact area and/or the one suction channel includes means for influencing the flow of the fluid so as to achieve essentially the same volume flow into the two suction chambers, wherein the impact area is defined by a transverse wall, and wherein the jet nozzle and the transverse wall are oriented with respect to each other such that the injected fluid impacts upon the wall in an oblique direction so as to advance the fluid along the one suction channel toward the two suction chambers, wherein the jet chamber communicates with one suction channel which serially communicates with the two suction chambers, and wherein the cross section of the suction channel decreases toward a first of the two serially arranged suction chambers.

25. The pump of claim 24 wherein the suction channel includes a guide surface of predetermined cross sectional configuration for influencing the fluid flow toward the suction chambers.

26. The pump of claim 24 wherein the cross section of the suction channel decreases between the first and the second serially arranged suction chambers.

27. A pump for delivering a fluid comprising a housing which comprises an interior chamber which accommodates a rotatable delivery device for displacing a fluid from an intake region to a delivery region, a feed channel formed in the housing and which communicates with a jet chamber which in turn communicates via at least one suction channel to at least two suction chambers which communicate with the intake region of the pump, and an injector device for injecting a pressurized fluid via a jet nozzle into the at least one jet chamber so as to entrain the fluid which flows into the jet chamber from the feed channel and thereby advance the fluid along the one suction channel and to the at least two suction chambers, said one jet chamber including an impact area which is impacted by the fluid injected by the injector device, and wherein the impact area and/or the one suction channel includes means for influencing the flow of the fluid so as to achieve essentially the same volume flow into the two suction chambers, wherein the impact area is defined by a transverse wall, and wherein the jet nozzle and the transverse wall are oriented with respect to each other such that the injected fluid impacts upon the wall in an oblique direction so as to advance the fluid along the one suction channel toward the two suction chambers, wherein the jet chamber communicates with one suction channel which serially communicates with the two suction chambers, and wherein the cross section of the suction channel between the first and the second serially arranged suction chambers is smaller than the cross section upstream of the first suction chamber.

28. A pump for delivering a fluid comprising a housing which comprises an interior chamber which accommodates a rotatable delivery device for displacing a fluid from an intake region to a delivery region, a feed channel formed in the housing and which communicates with a jet chamber which in turn communicates via at least one suction channel to at least two suction chambers which Communicate with the intake region of the pump, and an injector device for injecting a pressurized fluid via a jet nozzle into the at least one jet chamber so as to entrain the fluid which flows into the jet chamber from the feed channel and thereby advance the fluid along the one suction channel and to the at least two suction chambers, said one jet chamber including an impact area which is impacted by the fluid injected by the injector device, and wherein the impact area and/or the one suction channel includes means for influencing the flow of the fluid so as to achieve essentially the same volume flow into the two suction chambers, wherein the impact area is defined by a transverse wall, and wherein the jet nozzle and the transverse wall are oriented with respect to each other such that the injected fluid impacts upon the wall in an oblique direction so as to advance the fluid along the one suction channel toward the two suction chambers, wherein the jet chamber communicates with one suction channel which serially communicates with the two suction chambers, and wherein the region of the suction channel between the two suction chambers or downstream of the second serially arranged suction chamber, is connected to the jet chamber or to the region of the suction channel upstream of the first suction chamber.

* * * * *